United States Patent [19]

Moolman

[11] Patent Number: 4,741,718

[45] Date of Patent: May 3, 1988

[54] TOY WHEELED VEHICLE

[76] Inventor: Dirk J. Moolman, The Willow, Middleburg, C.P. 5900, South Africa

[21] Appl. No.: 329

[22] Filed: Jan. 2, 1987

[51] Int. Cl.[4] ..... A63H 17/38

[52] U.S. Cl. ..... 446/451; 446/471

[58] Field of Search ..... 446/451, 471, 470, 468, 446/460, 411

[56] References Cited

U.S. PATENT DOCUMENTS 3,721,042 3/1973 Marason, Jr. ..... 446/471

FOREIGN PATENT DOCUMENTS 932739 3/1948 France ..... 446/470
1118918 6/1956 France ..... 446/451
13522 of 1904 United Kingdom ..... 446/451
614569 7/1946 United Kingdom ..... 446/469

*Primary Examiner*—Mickey Yu
*Attorney, Agent, or Firm*—Dallett Hoopes

[57] ABSTRACT

Toy wheeled vehicle has a steering mechanism with steering column extending through the body of the vehicle upwardly and rearwardly and terminating in a steering wheel operable by a child standing above it. Couplers are provided for releasably securing different selected bodies to the vehicle frame. Each body has an opening in the top thereof to pass the steering column.

4 Claims, 4 Drawing Sheets

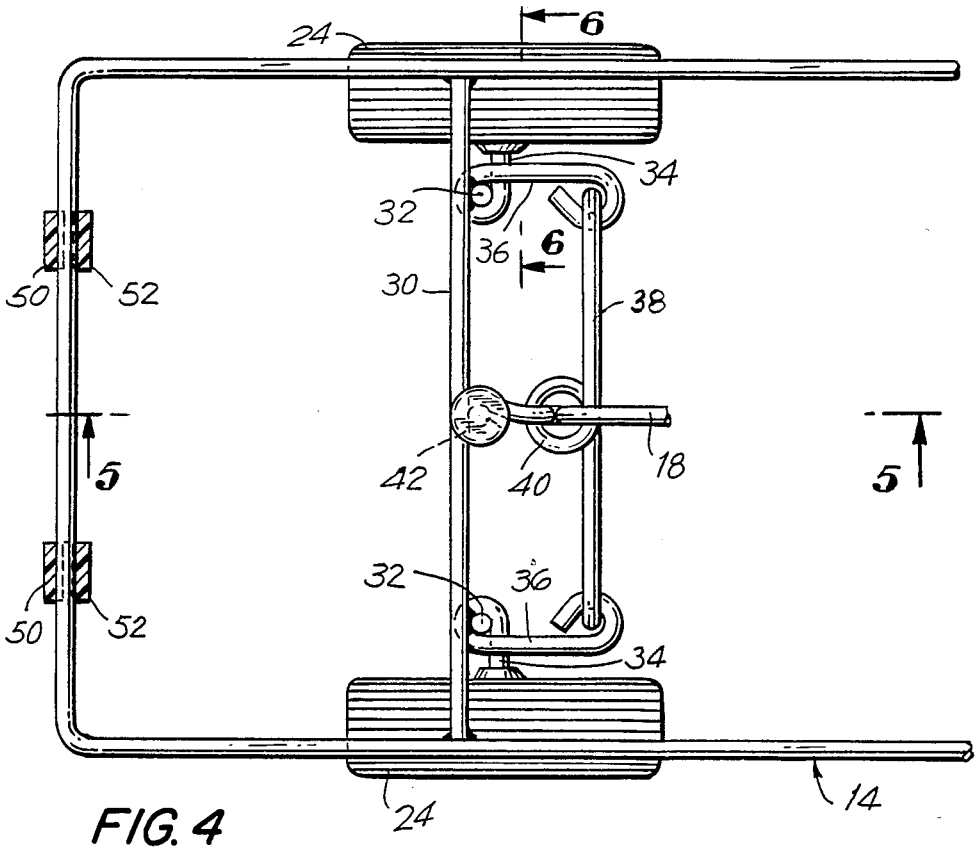
FIG. 4
FIG. 5
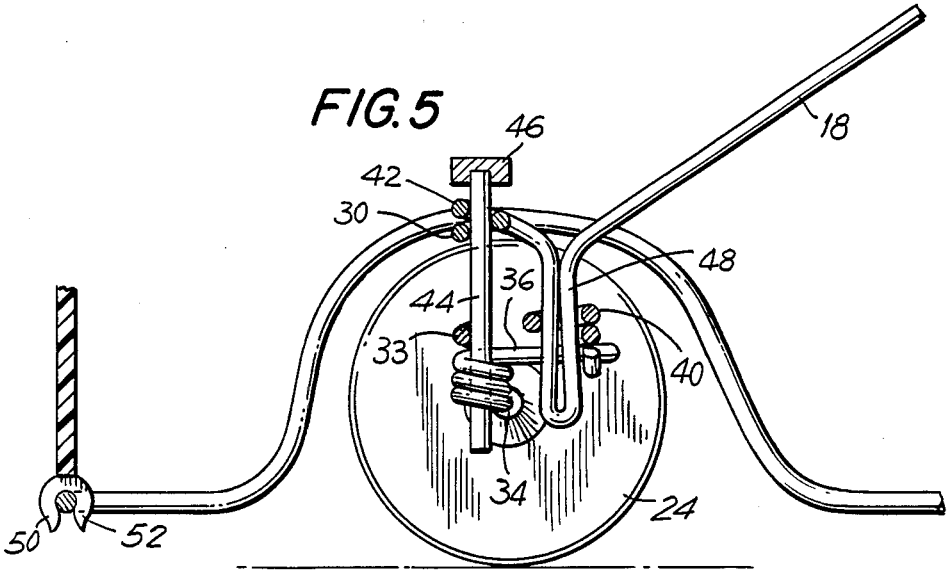

TOY WHEELED VEHICLE

BACKGROUND OF THE INVENTION

1. Field of the Invention

This invention relates to a toy wheeled vehicle. More specificially, this invention relates to a toy wheeled vehicle in which the steering mechanism comprises a rigid steering column operable by a steering wheel held by a standing child in a position well above the body of the vehicle. By means of the steering wheel the child can both steer and propel the vehicle. The invention further relates to such a toy vehicle having a plurality of body styles which may be selectively attached to the vehicle frame depending on the wishes of the child.

2. Description of the Prior Art

In the prior art there are a large number of toy vehicles having steering mechanism extending well above the vehicle so as to be operated by a child while standing. Representative samples of the prior art are U.S. Pat. No. 2,260,679 to Nielson; Austrian Pat. No. 141,331; German Pat. Nos. 186,813; 961,956; German publication No. 3,401,277; and the French Pat. No. 1,009,953. Each of the earlier products have the disadvantage that they are limited to specific set body styles which are not replaceable.

SUMMARY OF THE INVENTION

Under the present invention means are provided to removably attach selected body styles securely to the frame. Each of the body styles has an opening in the top thereof to permit the passing of the steering column so that the child can steer the vehicle and at the same time propel it by pushing on the rigid steering wheel.

Further objects of the invention will be apparent from an inspection of the following specification including the drawing wherein is disclosed a preferred embodyment of the invention.

BRIEF DESCRIPTION OF THE DRAWINGS

In the drawings:

FIG. 4 is an enlarged top plan view of the front end of the frame of the vehicle taken on line 4—4 of FIG. 1 with the vehicle body removed;

FIG. 5 is a sectional view taken on line 5—5 of FIG. 4;

DESCRIPTION OF THE PREFERRED EMBODIMENT

Figure 1:
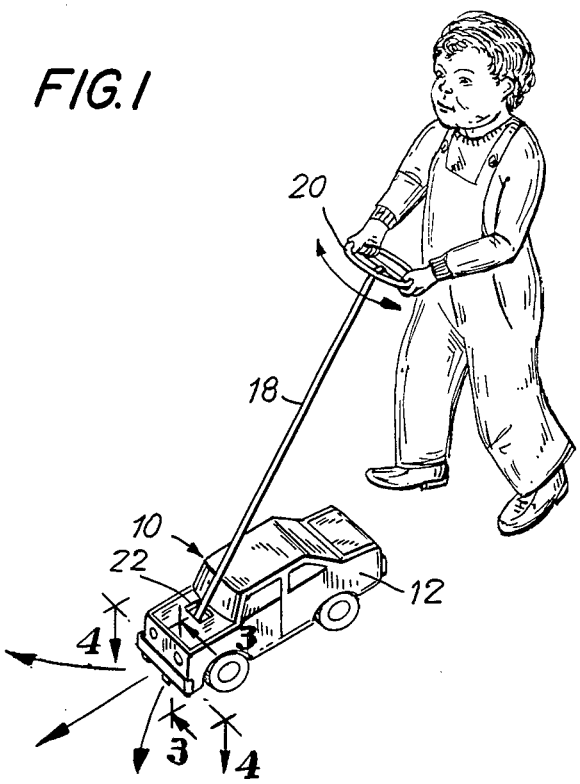
FIG. 1 is a perspective view of the toy wheeled vehicle embodying the invention being operated by a child.
Figure 6:
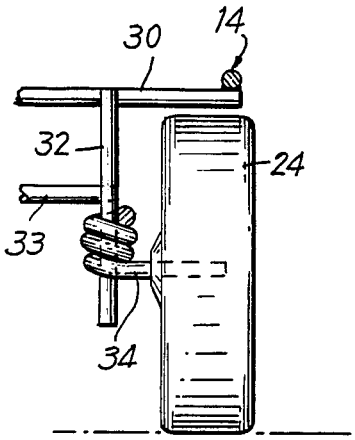
FIG. 6 is a sectional view taken on the line 6—6 of FIG. 4.
Figure 2:
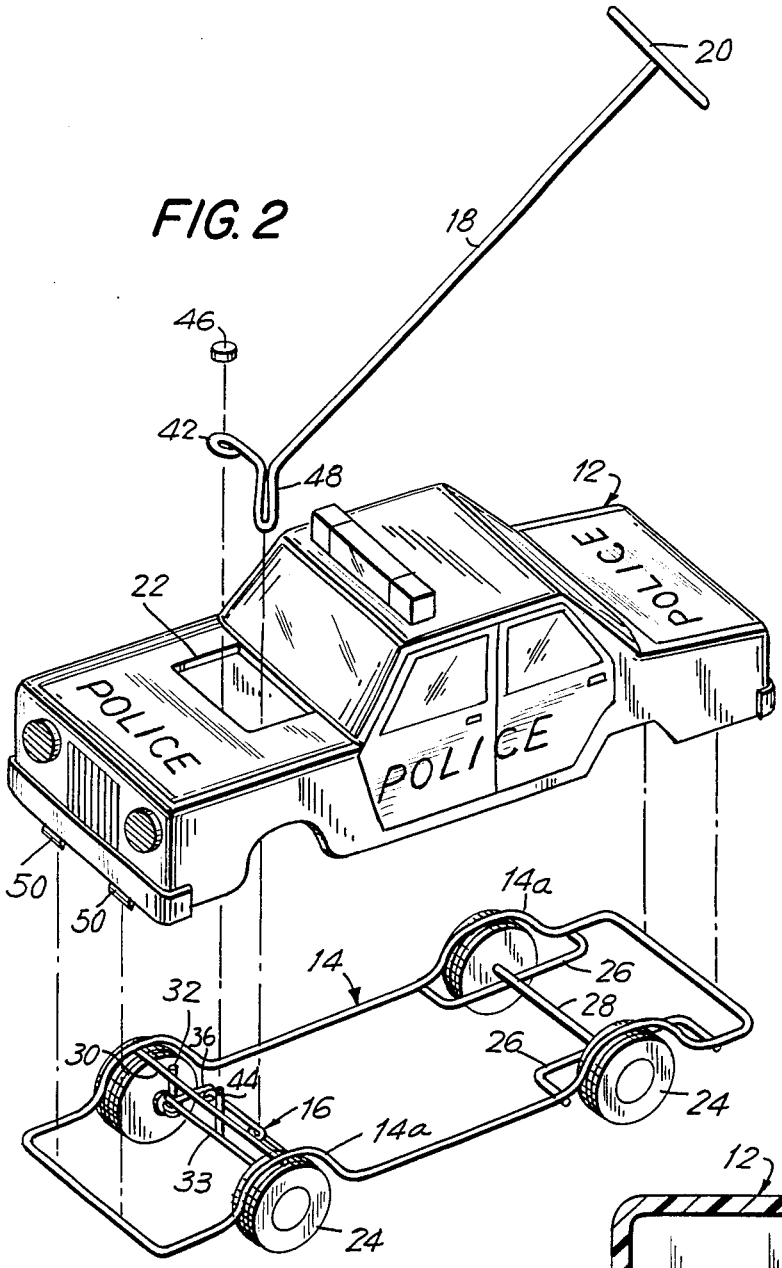
FIG. 2 is an enlarged exploded perspective view showing the frame, the body and the steering mechanism of a preferred form of the invention.
Figure 3:
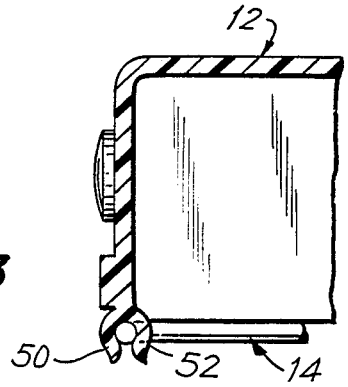
FIG. 3 is a sectional view taken on line 3—3 of FIG. 1.
Figure 7:
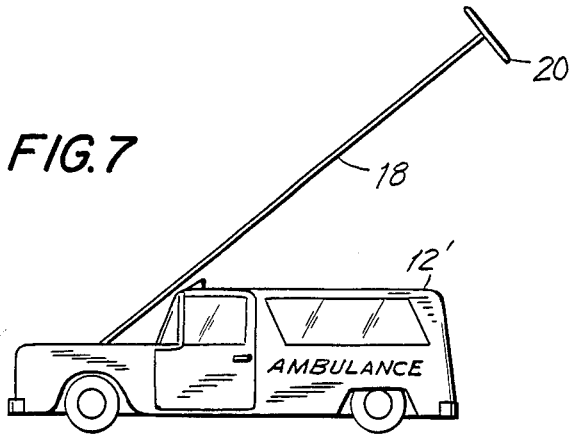
FIGS. 7 through 10 show variations on the body styles suitable for in the invention.
Figure 8:
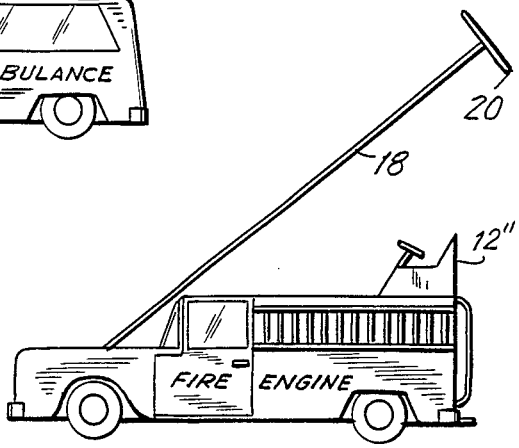
Figure 9:
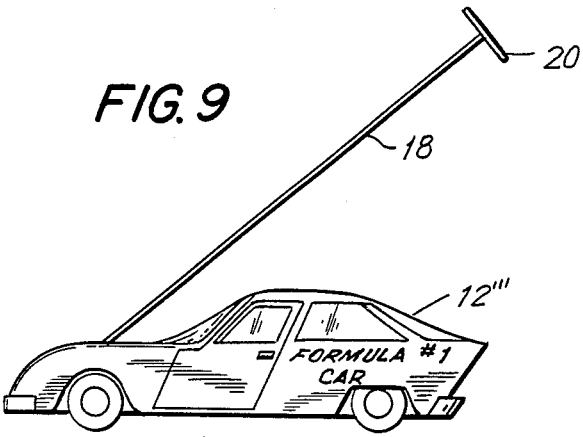

A toy wheeled vehicle embodying the invention is shown in FIG. 1 and designated 10. It comprises a body 12 having a frame 14 (FIG. 2).

A steering mechanism 16 is provided in the front end of the frame and includes a rigid steering column 18 extending upwardly through the body and terminated in a steering wheel 20. A rectangular opening 22 in the body 12 permits passing of the steering column 18.

The frame (FIG. 2) is a generally rectangular wire structure with the wire deflected upward as at **14*a* above each of the wheels 24. Welded or otherwise secured to the rectangular frame in the area of the rear wheels is an inward U-shaped support 26 to which is secured the rear axle 28 on the ends of which the wheels 24** are rotatably fastened.

Extending between the tops of the deflection **14*a* near the front end of the vehicle frame is the bridge member 30 to support the steering mechanism 16. Short vertical shafts 32 extend downward at points spaced inward from the wheels and form pivots respectively for the front wheels. The wheels rotate on the axles 34. Inward from the wheels the axles rotatably surround the respective shafts 32 and then present turning arms 36 extending rearwardly and parallel to the wheels. Lower bridge 33 connects shafts 32 and pin 44. A tie rod 38 is loosely connected between loops on the distal ends of the arms 36 and the tie rod is formed with an eye 40 adjacent its mid-point. Lateral movement of the eye 40 causes the arms 36 and the front axles 34 to pivot about the shafts 32 respectively. The steering column 18 terminates forwardly in a circle or terminal 42 (FIG. 5) which is looped around the fixed vertical pin 44 secured to support 30. The top of the pin 44 is covered by a retainer button 46 which keeps the terminal 42 on pin 44**.

The steering column has downwardly extending section 48. In the embodiment shown section 48 is a downward and doubled back run of the stiff wire column 18. The section 48 fits somewhat loosely in the eye 40 so that when column 18 is turned by the child the terminal 42 pivots about pin 44 and the section 48 engages eye 40 to move the tie rod 30 laterally of the frame to steer the wheels 24.

The car body 12 is preferably a plastic molded structure having side walls aligned with the frame 14. Spaced about the perimeter of the lower end of the body are sets of fingers 50,52. Adjacent fingers 50,52 have inwardly facing concave surfaces with respect to the wire frame 14 and fit in snap engagement thereover to secure the body to the frame. Preferably the adjacent fingers 50,52 are aligned on opposite sides of the wire. The sets of fingers are speaced about the vehicle, preferably at each end of the body to secure the body to the frame. For simplicity only the front sets are shown.

Figure 10:
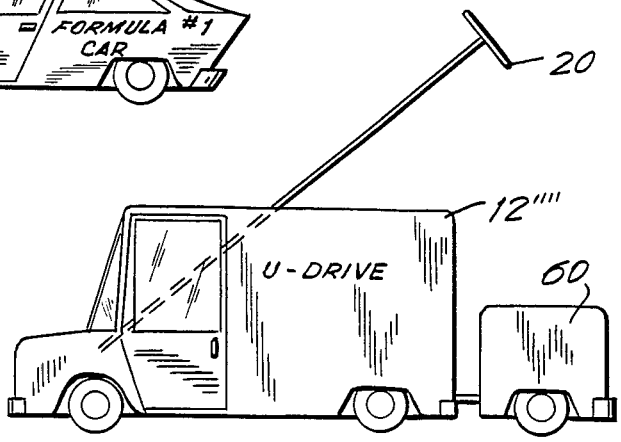

FIGS. 7 through 10 disclose various types of bodies 12' and 12'', 12''', 12''''''. In FIG. 10 version a trailer 60 hooked on to the rear end of the body 12'''' adds an attractive acoutrement.

In use, when the child tires of the body style he has earlier selected, he may snap that body off the frame by pulling the body and frame apart. Thereafter the circle 42 may be removed from the shaft 44 after taking off the button 46. Then the steering column 18 may be removed thru the opening 22 on the old body. When the new body is selected the child pokes the end of the column 18 thru opening 22, inserts section 48 into eye 16 and the terminal 42 over shaft 44, replacing button 46. The new body can be snapped on to the frame 14 by engaging the sets of fingers 50,52 to the wire.

It can be seen that by having a plurality of bodies selectively available for replacement on the frame the present vehicle for the child's purpose becomes a plurality of toy vehicles. The result is an economy in purchasing price of vehicles and the intriguing replacement and installation process which may be regarded as an educational experience for the child.

The car is manipulated in the usual manner using the steering wheel in its steering function as described and, because the column 18 is rigid, the vehicle propelling function as well.

While the invention has been described in only a single form, it is not so limited but is susceptible of many changes. What is desired in the patent coverage on this subject is the scope of the invention as defined by the following claim language and equivalents thereof.

I claim:

1. A toy wheeled vehicle comprising a wire frame having a generally rectangular lower frame element and a pair of aligned steerable wheels having horizontal axles, and a steering mechanism comprising a pair of spaced upstanding vertical wires secured to the frame element to which the axles of the wheels are respectively pivoted, the axles each having wire steering arms extending rearward of the vehicle and parallel to the respective wheels, a wire tie rod pivotally connected between the distal ends of the arms and being formed with an eye adjacent to its midpoint, a steering column being pivotally attached to the frame forward of the eye and having a downwardly extending section extending into the eye whereby turning a steering wheel attached to said column causes the tie rod to move laterally of the vehicle thereby pivoting the wheels about said vertical wires, and a plurality of different molded vehicle bodies adapted to fit selectively over the frame, each body having adjacent its lower end a plurality of resilient fingers, adjacent fingers having opposed concave faces, the body adapted to be fitted over the frame with the faces of adjacent fingers engaging opposite sides of the wire in frictional engagement, the steering column extending upward well above the vehicle body.

2. A toy wheeled vehicle as claimed in claim 1 wherein the adjacent fingers are aligned with each other on opposite sides of the wire.

3. A toy wheeled vehicle as claimed in claim 1 wherein the adjacent fingers are arranged in opposed sets aligned on opposite sides of the wire, two such sets being disposed at the front end of the vehicle.

4. A toy wheeled vehicle as claimed in claim 1 wherein the top of the body is formed with a rectangular cut out and the steering column passes through said opening.

* * * * *